US006038329A

United States Patent [19]

Lee

[11] Patent Number: 6,038,329

[45] Date of Patent: Mar. 14, 2000

[54] EARPHONE DEVICE

[76] Inventor: Youn M. Lee, 13906 Springhouse Ct., Clifton, Va. 20124

[21] Appl. No.: 08/880,797

[22] Filed: Jun. 23, 1997

Related U.S. Application Data

[60] Provisional application No. 60/021,352, Jul. 8, 1996.

[51] Int. Cl.[7] ..... H04R 25/00

[52] U.S. Cl. ..... 381/370; 381/374; 379/430

[58] Field of Search ..... 381/370, 374, 381/371, 376, 430, 377, 378, 379; 379/430

[56] References Cited

U.S. PATENT DOCUMENTS

| | | | |
|---|---|---|---|
| D. 242,724 | 12/1976 | Brodie . | |
| D. 350,757 | 9/1994 | Carpenter . | |
| 1,579,412 | 4/1926 | Stenberg | 381/378 |
| 2,303,961 | 12/1942 | Sprague . | |
| 2,666,973 | 1/1954 | Mosley . | |
| 3,787,899 | 1/1974 | Krawagna | 2/209 |
| 4,453,050 | 6/1984 | Enokido . | |
| 4,546,215 | 10/1985 | Ferraro | 179/156 R |
| 4,609,786 | 9/1986 | Omoto et al. | 179/156 |
| 4,654,898 | 4/1987 | Ishiwaka | 381/187 |
| 4,701,983 | 10/1987 | Warmath . | |
| 4,932,052 | 6/1990 | Lo . | |
| 5,293,647 | 3/1994 | Mirmilshteyn | 2/209 |
| 5,412,736 | 5/1995 | Keliiliki . | |
| 5,737,436 | 4/1998 | Boyden | 381/187 |
| 5,790,683 | 6/1995 | Salzani | 381/183 |

FOREIGN PATENT DOCUMENTS

| | | |
|---|---|---|
| 353758 | 12/1922 | Germany . |
| 3233375 | 3/1984 | Germany . |

*Primary Examiner*—Curtis A. Kuntz
*Assistant Examiner*—Dionne Harvey
*Attorney, Agent, or Firm*—Richard C. Litman

[57] ABSTRACT

An earphone device independently securable to each ear, with a retainer having two ends. A speaker is coupled to one end of the retainer while a cushion disc is coupled to the other end, and is designed to fit within a recessed area of the outer ear. The earphone device is retained through resilient biasing of the retainer on the ear. The earphone device also includes structure for exerting force thereon in order to urge the first and second ends of the retainer away from each other, thereby providing sufficient spacing to allow removal thereof. The earphone device may have a detachable earmuff designed to protect the user's ear during cold weather conditions. Hook and loop type fasteners are on the retainer and the earmuff in order to provide easy attachment and removal of the earmuff. The invention may also be configured as an earmuff which is capable of attachment to an individual ear.

16 Claims, 3 Drawing Sheets

EARPHONE DEVICE

CROSS-REFERENCE TO RELATED APPLICATION

This application claims the benefit of U.S. Provisional Patent Application Serial No. 60/021,352, filed Jul. 8, 1996.

BACKGROUND OF THE INVENTION

1. Field of the Invention

The present invention relates generally to earphones, and more. specifically to those earphones capable of being independently secured to each ear.

2. Description of the Prior Art

Many users of small portable radio or tape players often have difficulty with the earphones. Joggers or other persons engaged in athletic activities find that the earphones have a tendency to slip or fall out. To solve this problem the users would use earphones that either completely block the ear canal or fit tightly within the ear canal. This can cause damage to the user's hearing while also preventing the user from hearing surrounding noise. The inability to hear surrounding noise is dangerous both to an outdoors athlete and a person driving a vehicle while listening to a radio or tape player. In addition, most present headsets are designed for the user to place an earphone in each ear.

Persons not engaged in athletic activity still face some of the same problems listed above. They also worry about earphones that tend to slip out easily or do not dependably stay in place. In addition, such users also worry about headsets which have a tendency to become entangled within or otherwise disturb the styling of their hair.

Thus, both athletic and non-athletic users would appreciate having a headset suited for use during cold weather while allowing quick and easy affixation of an earmuff to the earphone. Such an adaption would allow comfortable use of the headset during cold weather. Accordingly, there is a need for an earphone that is convenient, easy to place on and remove, while being able to accommodate earmuffs thereon.

Earphone and clamping devices have been described in the patent literature. For example, U.S. Pat. No. 2,303,961 issued on Dec. 1, 1942 to Sprague discloses a clothespin which can be easily applied to a garment and attached to a line.

U.S. Pat. No. 2,666,973 issued on Jan. 26, 1954 to Mosley discloses a clamping attachment for earrings having a clamping head which presents a relatively large bearing surface to an ear lobe in order to prevent injury or discomfort when brought into clamping engagement.

U.S. Pat. No. 4,453,050 issued on Jun. 5, 1984 to Enokido discloses an improved earphone having a transducer within its housing, and a curved lever for engaging the ear. The transducer is spaced an appropriate distance for radiating sound into the ear, and can be aligned relative to an angle of the ear without placing excessive pressure on the ear.

U.S. Pat. No. 4,654,898 issued on Apr. 7, 1987 to Ishikawa discloses a removable ear muff for headphones. The ear muff is constructed with a support cup that is covered by fabric, wool, or other material which engages and partially surrounds the ear of the wearer to keep it warm in cold weather.

U.S. Pat. No. 4,932,052 issued on Jun. 5, 1990 to Lo discloses a self-adjusting headset-handset combination which includes a cylindrical speaker housing that fits into the pinna and contains a speaker.

U.S. Pat. No. 5,412,736 issued on May 2, 1995 to Keliiliki discloses an earphone capable of secure carriage on the ear of a user, even during vigorous physical activity. The earphone includes a lightweight audio speaker supported on a flexible, open-looped earpiece ergonomically tailored to cradle the ear without significant resilient deformation.

U.S. Pat. No. Des. 242,724 issued on Dec. 14, 1976 to Brodie discloses an ornamental design for a headset, while U.S. Pat. No. Des. 350,757 issued on Sep. 20, 1994 to Carpenter discloses an ornamental design for a clip-on earphone.

German Pat. Nos. 3,233,375 issued on August 1984 and 353,758 issued on May 1922 both disclose earphones capable of being supported on the ear.

None of the above inventions and patents, taken either singly or in combination, is seen to describe the instant invention as claimed.

SUMMARY OF THE INVENTION

Accordingly, it is a principal object of the invention to provide an earphone device.

It is another object of the invention to provide an earphone device capable of insulating the ear of an individual in cold weather.

It is a further object of the invention to provide an earmuff capable of being individually supported by each ear.

It is an object of the invention to provide improved elements and arrangements thereof in an apparatus for the purposes described which is inexpensive, dependable and fully effective in accomplishing its intended purposes.

In accordance with the objects of the invention, an earphone device is provided. The earphone device includes a retainer having two ends. A speaker, designed to fit within a recessed area of the outer ear, is mounted on one end of the retainer. The earphone device is retained through resilient bias of the retainer on the ear. The second end of the retainer may be provided with a cushion disc for comfortably contacting the back of the ear. The earphone device also includes means for exerting force thereon in order to urge the first and second ends of the retainer away from each other and remove it.

In preferred embodiments of the invention, the earphone device may be provided with a detachable earmuff to protect the user during cold weather. Hook and loop type fasteners are correspondingly disposed on the retainer and on the earmuff in order to provide easy attachment and removal of the earmuff. The invention may also be configured as an earmuff capable of attachment to an individual ear.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
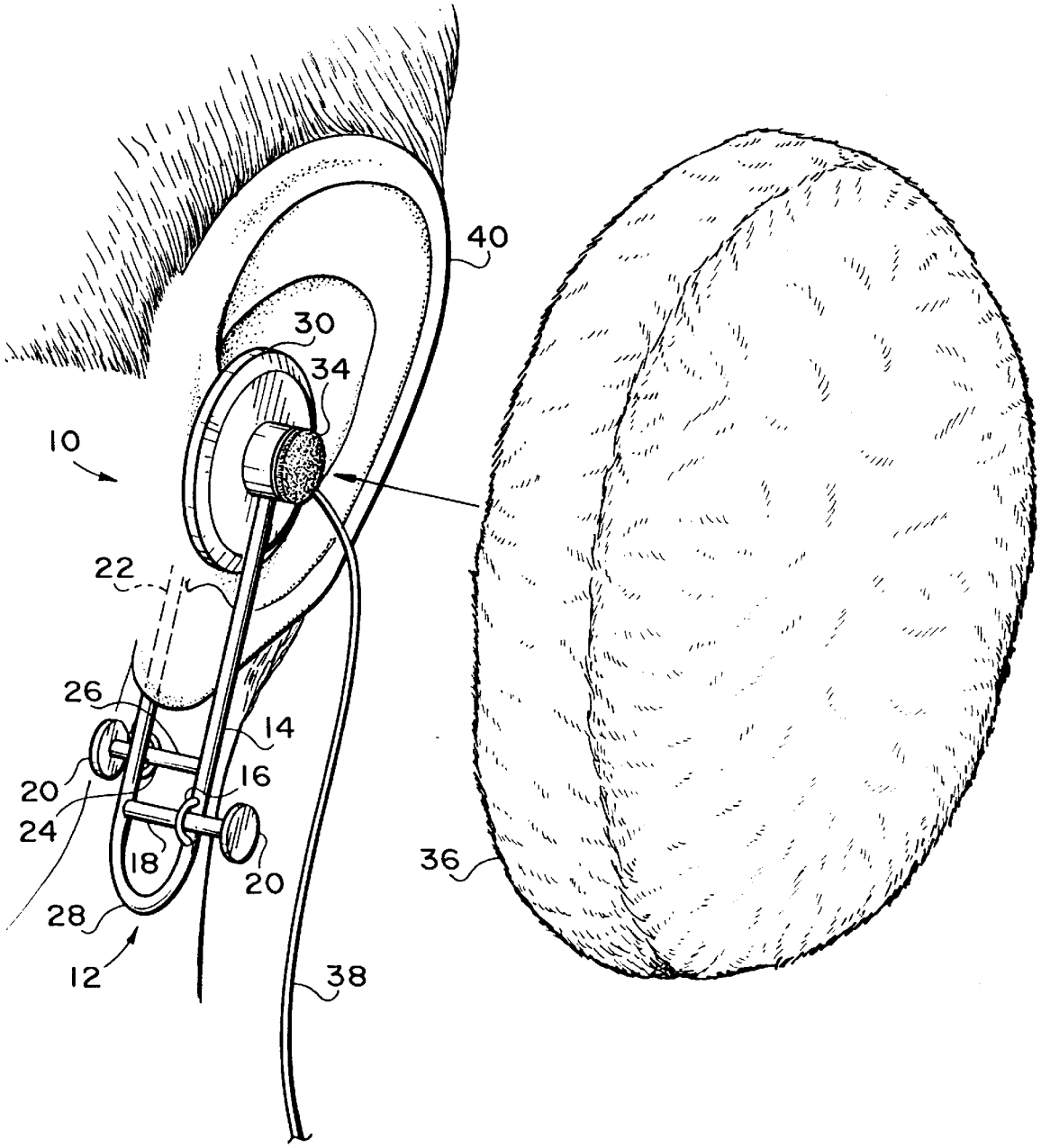
FIG. 1 is an environmental perspective view of an earphone device in accordance with the present invention.

Referring to the drawings and initially to FIG. 1 of the drawings, an earphone device 10 is shown attached to the ear 40 of a user. The earphone device 10 includes a retainer 12 and a speaker 30 attached thereto. A speaker wire 38 is provided to couple the speaker 30 to a desired audio device. The retainer 12 has a first leg 14 and a second leg 22 which are generally parallel to one another. The retainer 12 also includes a U-shaped bend 28 which integrally connects the first and second legs 14, 22. The speaker 30 is designed to fit within a recessed area of the ear 40. The U-shaped bend 28 is resilient and designed to bias the first and second legs 14, 22 toward one another. The first and second legs 14, 22 are designed with a predetermined spacing between them in order to remain properly positioned on the ear 40. A cushion disc 32 (see FIG. 3) may be provided for comfortably contacting the back of the ear 40.

A first snap loop 16 is disposed on the first leg 14, while a second snap loop 24 is disposed on the second leg 22. A first tension rod 18 extends perpendicularly from the second leg 22. The first tension rod 18 sized and oriented such that it passes through the first snap loop 16. The first tension rod 18 is also dimensioned to extend a predetermined distance beyond the first snap loop 16. A disc 20 is coupled to the free end of the first tension rod 18. A second tension rod 26 extends perpendicularly from the first leg 14, and is similarly sized and oriented for passage through the second snap loop 24.

As seen in FIG. 1, an earmuff 36 is removably securable to the earphone device 10. A patch of hook and loop fastener 34 is disposed on the back of the speaker 30. The earmuff 36 includes the corresponding patch (not shown) required to engage the patch of hook and loop fastener 34 disposed on the back of the speaker 30. The earmuff 36 functions to shield the ear 40 of the user from excessive cold weather without having to sacrifice the earphone device 10 for traditional earmuffs.

Placement of the earphone device 10 over the ear 40 may be easily accomplished by first exerting pressure on the discs 20 of the first and second tension rods 18, 26. Since the U-shaped bend 28 is resilient, the first and second legs 14, 22 are urged away from each other in order to provide sufficient clearance for passage over the ear 40. As pressure is exerted on the discs 20, the first and second snap loops 16, 24 prevent the first and second tension rods 18, 26 from diverging from the prescribed range of motion necessary to force the first and second legs 14, 22 apart. The discs 20 also function to restrict the range of travel of the first and second tension rods 18, 26. The speaker 30 is then appropriately positioned over the ear 40 and the discs 20 are released. The retainer 12 is secured with the ear 40 between the first and second legs 14, 22.

Figure 2:
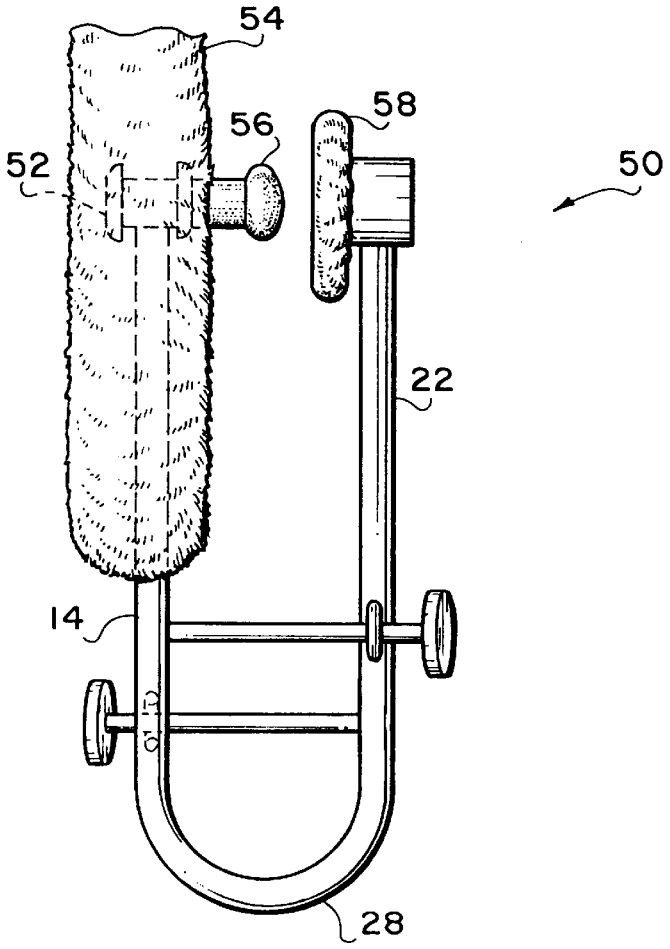
FIG. 2 is a perspective view of a second embodiment of the present invention.

Referring now to FIG. 2, the invention is shown embodied as an earmuff device 50. The earmuff device 50 is configured similar to the earphone device 10 previously described with the exception of the speaker 30. A clip 52 is coupled to the free end of the first leg 14. An earmuff 54 is provided with backing 56 centrally attached thereto. The backing 56 is designed to engage the clip 52 and secure the earmuff 54 to the earmuff device 50. The backing 56 may be constructed of soft materials for comfortable disposition within a recessed portion of the ear 40 of the user.

Figure 3:
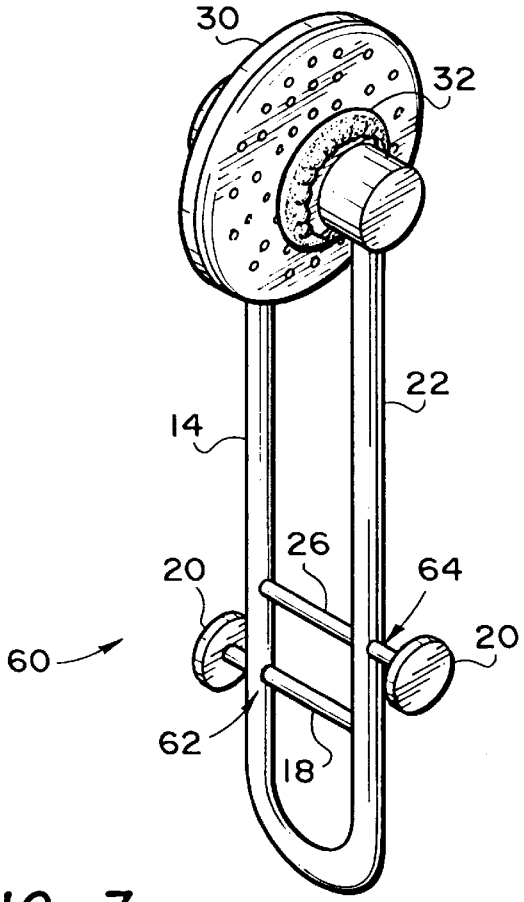
FIG. 3 is a perspective view of a third embodiment of the invention.

FIG. 3 illustrates a third embodiment of the invention. An earphone device 60 is shown which includes a first aperture 62 contained in the first leg 14, and a second aperture 64 contained in the second leg 22. The first and second apertures 62, 64 replace the first and second snap loops 16, 24 and, therefore, are sized to receive the first and second tension rods 18, 26 therethrough. Accordingly, the first and second apertures 62, 64 function to guide the first and second tension rods 18, 26 when pressure is exerted on the discs 20.

Figure 4:
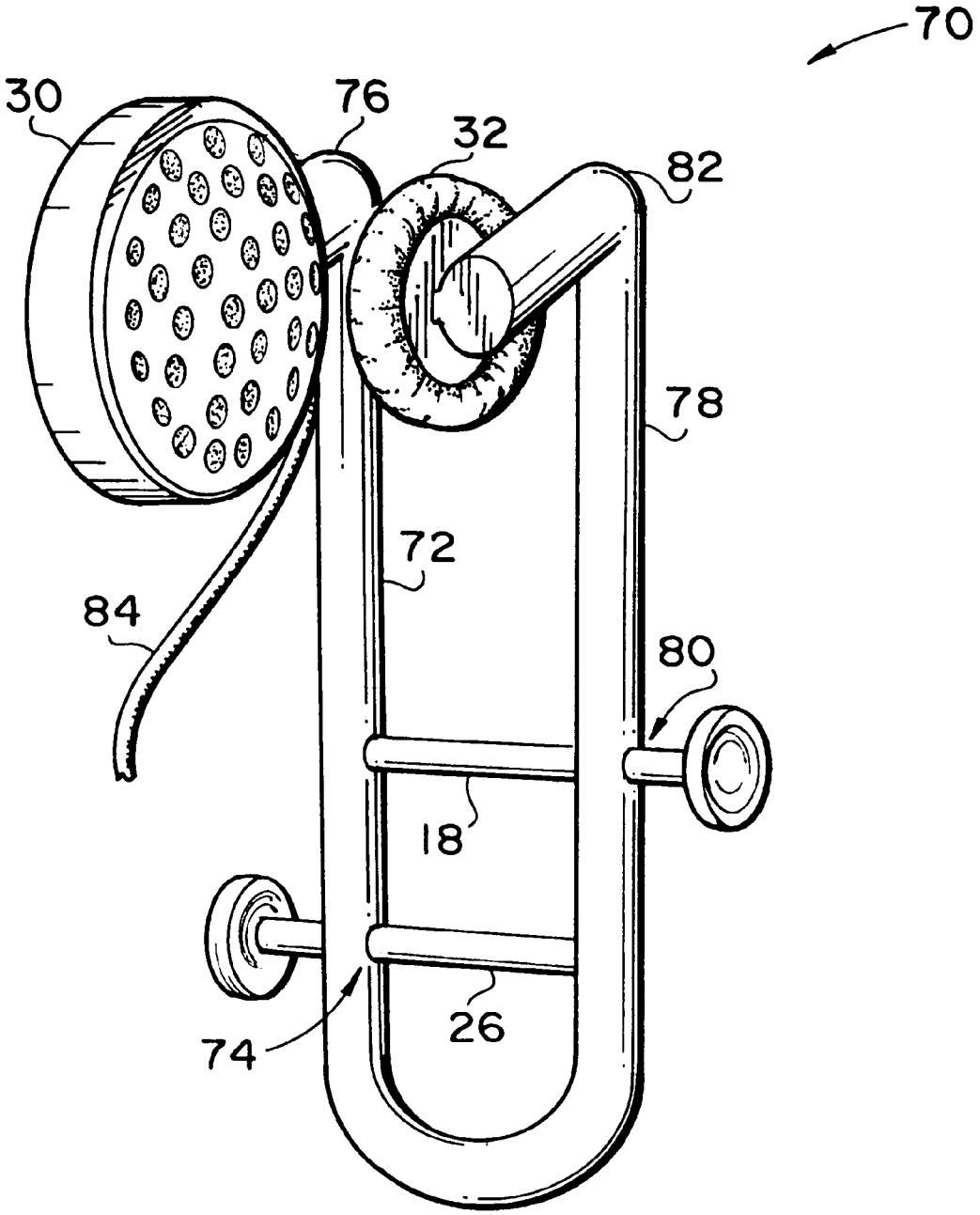
FIG. 4 is a perspective view of a fourth embodiment of the present invention.

FIG. 4 illustrates a fourth embodiment of the invention. An earphone device 70 is shown to include a first aperture 74 contained in the first leg 72, and a second aperture 80 contained in the second leg 78. The first and second apertures 74, 80 are appropriately sized to receive the first and second tension rods 18, 26. The first leg 72 includes a first bend 76 proximate its terminal end, while the second leg 78 includes a second bend 82 proximate its terminal end. The first and second bends 76, 82 function to more comfortably position the speaker 30 and the cushion disc 32 on the ear 40 of the user. Speaker 30 is provided with a speaker wire 84, coupling the speaker 30 to a desired audio device, similar to the speaker wire 38 of FIG. 1.

It should be appreciated that the earphone device 10 of the present invention provides many advantages over other headsets. For example, the earphone device 10 is easily retained on each ear 40 of the user. Furthermore, the inherent resiliency of the U-shaped bend 28 assures that the earphone device 10 will not be dislodged during vigorous activities. In preferred embodiments of the invention, the retainer 12 is made of light weight resilient materials such as plastic or beryllium copper alloys.

It is to be understood that the present invention is not limited to the embodiments described above, but encompasses any and all embodiments within the scope of the following claims.

I claim:

1. An earphone device comprising:

a retainer having a first end and a second end, a first leg terminating at said first end, a second leg terminating at said second end, said second leg being oriented parallel to said first leg, and a U-shaped bend integrally connecting said first leg to said second leg, said retainer being positionable around the outer ear of an individual;

a speaker attached to the first end of said retainer, said speaker being sized to fit into a recessed area of the outer ear, said retainer fixedly securing said speaker in the recessed area of the outer ear; and means for urging the first and second ends of said retainer away from each other in order to facilitate removal said earphone device, wherein said means for urging comprises:

a first snap loop coupled to said first leg;

a second snap loop coupled to said second leg;

a first tension rod extending perpendicularly from said second leg, said first tension rod being sized and aligned for insertion through said first snap loop;

a second tension rod extending perpendicularly from said first leg, said second tension rod being sized and aligned for insertion through said second snap loop; and a disc attached to the free end of each of said tension rods for limiting the travel thereof, and for providing a surface upon which force may be exerted for urging said first and second legs away from each other.

2. The earphone device as recited in claim 1, further comprising a cushion disc secured to the second end of said retainer, for comfortably contacting the back of the outer ear.

3. The earphone device as recited in claim 1, further comprising insulation means for protecting the outer ear from cold weather, and means for removably securing said insulation means to said retainer.

4. The earphone device as recited in claim 3, wherein said insulation means comprises an earmuff, and said means for removably securing comprises hook and loop fasteners correspondingly disposed on said earmuff and on the first end of said retainer on the side opposite of said speaker.

5. The earphone device as recited in claim 1, wherein said first leg includes a bend proximate said first end, and said second leg includes a bend proximate said second end.

6. An earphone device for disposition around an individual ear of a user for reproducing audible sounds, said device comprising:

a retainer having a first leg terminating at a first end, a second leg terminating at a second end, said second leg being oriented parallel to said first leg, and a U-shaped bend integrally connecting said first leg to said second leg, said retainer removably attachable about the outer ear;

a speaker attached to the first end of said retainer, said speaker being sized to fit into a recessed area of the outer ear; and means for urging the first and second ends of said retainer away from each other, said means including a first snap loop coupled to said first leg, a second snap loop coupled to said second leg, a first tension rod extending perpendicularly from said second leg, said first tension rod being sized and aligned for insertion through said first snap loop, a second tension rod extending perpendicularly from said first leg, said second tension rod being sized and aligned for insertion through said second snap loop, and a disc attached to the free end of each of said tension rods for limiting the travel thereof, and for providing a surface upon which force may be exerted for urging said first and second legs away from each other;

wherein said means for urging facilitate removal said retainer from the individual ear.

7. The earphone device as recited in claim 6, further comprising a cushion disc secured to the second end of said retainer, for comfortably contacting the back of the outer ear.

8. The earphone device as recited in claim 6, further comprising insulation means for protecting the outer ear from cold weather, and means for removably securing said insulation means to said retainer.

9. An earphone device disposed about an ear of a user for reproducing audible sounds, said device comprising:

speaker means for generating audible sounds to the ear of the individual, said speaker means conformed to comfortably and snugly fit into a recessed area of the outer ear;

retainer means, positionable around the outer ear, for removably securing said speaker means to the outer including a first end and a second end, a first leg terminating at said first end, a second leg terminating at said second end, said second leg being oriented parallel to said first leg, and a U-shaped bend integrally connecting said first leg to said second leg; and means for urging the first and second ends of said retainer away from each other, said means for urging including a first aperture in said first leg, a second aperture in said second leg, a first tension rod extending perpendicularly from said second leg, said first tension rod being sized and aligned for passage through said first aperture, a second tension rod extending perpendicularly from said first leg, said second tension rod being sized and aligned for passage through said second aperture, and a disc attached to the free end of each of said tension rods;

whereby said disc limits the travel of said first and second tension rods, and provides a surface upon which force is exerted urging said first and second ends away from each other.

10. The earphone device as recited in claim 9, further comprising a cushion disc secured to the second end of said retainer, for comfortably contacting the back of the outer ear.

11. The earphone device as recited in claim 9, further comprising insulation means for protecting the outer ear from cold weather, and means for removably securing said insulation means to said retainer.

12. An earphone device comprising:

a retainer having a first end and a second end, a first leg terminating at said first end, a second leg terminating at said second end, said second leg being oriented parallel to said first leg, and a U-shaped bend integrally connecting said first leg to said second leg, said retainer being positionable around the outer ear of an individual;

a speaker attached to the first end of said retainer, said speaker being sized to fit into a recessed area of the outer ear, said retainer fixedly securing said speaker in the recessed area of the outer ear; and means for urging the first and second ends of said retainer away from each other in order to facilitate removal said earphone device, wherein said means for urging comprises:

a first aperture in said first leg;

a second aperture in said second leg;

a first tension rod extending perpendicularly from said second leg, said first tension rod being sized and aligned for passage through said first aperture;

a second tension rod extending perpendicularly from said first leg, said second tension rod being sized and aligned for passage through said second aperture; and a disc attached to the free end of each of said tension rods for limiting the travel thereof, and for providing a surface upon which force may be exerted for urging said first and second legs away from each other.

13. The earphone device as recited in claim 12, further comprising a cushion disc secured to the second end of said retainer, for comfortably contacting the back of the outer ear.

14. The earphone device as recited in claim 12, further comprising insulation means for protecting the outer ear from cold weather, and means for removably securing said insulation means to said retainer.

15. An earphone device as recited in claim 14, wherein said insulation means comprises an earmuff, and said means for removably securing comprises hook and loop fasteners correspondingly disposed on said earmuff and on the first end of said retainer on the side opposite of said speaker.

16. The earphone device as recited in claim 12, wherein said first leg includes a bend proximate said first end, and said second leg includes a bend proximate said second end.

* * * * *